US007252914B2

(12) United States Patent
Nakamura et al.

(10) Patent No.: US 7,252,914 B2
(45) Date of Patent: Aug. 7, 2007

(54) TONER FOR ELECTROPHOTOGRAPHY AND DEVELOPER FOR ELECTROPHOTOGRAPHY USING THE SAME, PROCESS CARTRIDGE, APPARATUS FOR FORMING IMAGE, AND METHOD FOR FORMING IMAGE

(75) Inventors: Yasushige Nakamura, Kawasaki (JP); Tomoaki Tanaka, Kawasaki (JP); Seijiro Ishimaru, Kawasaki (JP); Sadaaki Yoshida, Kawasaki (JP); Yoshimichi Katagiri, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 3 days.

(21) Appl. No.: 10/278,900

(22) Filed: Oct. 24, 2002

(65) Prior Publication Data

US 2003/0190537 A1 Oct. 9, 2003

(30) Foreign Application Priority Data

Mar. 19, 2002 (JP) ..... 2002-077038

(51) Int. Cl.
*G03G 13/01* (2006.01)
*G03G 9/08* (2006.01)

(52) U.S. Cl. ..... 430/45; 430/107.1; 430/108.4; 430/108.8; 430/109.4; 399/119; 399/252; 399/336

(58) Field of Classification Search ..... 430/108.1, 430/108.4, 108.8, 109.4, 111.4, 45, 107.1, 430/124; 399/336, 252, 119
See application file for complete search history.

(56) References Cited

U.S. PATENT DOCUMENTS

| | | | | |
|---|---|---|---|---|
| 3,869,612 | A * | 3/1975 | Lenhard | 250/319 |
| 4,699,863 | A | 10/1987 | Sawatari et al. | |
| 4,788,123 | A * | 11/1988 | Berkes et al. | 430/124 |
| 5,254,421 | A * | 10/1993 | Coppens et al. | 430/49 |
| 5,364,722 | A | 11/1994 | Tanikawa et al. | |
| 5,863,697 | A | 1/1999 | Uchiyama et al. | |
| 6,015,647 | A * | 1/2000 | Ugai et al. | 430/108.4 |
| 6,077,639 | A * | 6/2000 | Semura et al. | 430/109.4 |
| 6,136,488 | A | 10/2000 | Kushino et al. | |
| 6,268,099 | B1 | 7/2001 | Eguchi et al. | |
| 6,356,729 | B1 * | 3/2002 | Sasaki et al. | 399/258 |
| 6,415,122 | B1 * | 7/2002 | Hara et al. | 399/128 |
| 6,537,716 | B1 * | 3/2003 | Doi et al. | 430/108.23 |
| 6,623,901 | B1 * | 9/2003 | Kohtaki et al. | 430/190.4 |
| 6,633,740 | B2 * | 10/2003 | Estabrooks | 399/384 |
| 2003/0118366 | A1 * | 6/2003 | Nukada et al. | 399/109 |
| 2003/0186148 | A1 * | 10/2003 | Nakamura et al. | 430/107.1 |

FOREIGN PATENT DOCUMENTS

| | | |
|---|---|---|
| EP | 0 662 640 A2 | 7/1995 |
| EP | 0 869 399 A2 | 10/1998 |
| EP | 0 961 175 A2 | 12/1999 |
| EP | 1 109 069 A2 | 6/2001 |
| JP | 52-3305 | 1/1977 |
| JP | 52-23304 | 1/1977 |
| JP | 58-102247 | 6/1983 |
| JP | 58-102248 | 6/1983 |
| JP | 58-215659 | 12/1983 |
| JP | 60-57857 | 4/1985 |
| JP | 60-57858 | 4/1985 |
| JP | 60-63545 | 4/1985 |
| JP | 60-63546 | 4/1985 |
| JP | 60-131544 | 7/1985 |
| JP | 60-133460 | 7/1985 |
| JP | 61-132959 | 6/1986 |
| JP | 62-100775 | 5/1987 |
| JP | 4-124676 | 4/1992 |
| JP | 4-299357 | 10/1992 |
| JP | 57-52574 | 11/1992 |
| JP | 4-362953 | 12/1992 |
| JP | 5-197192 | 8/1993 |
| JP | 5-249734 | 9/1993 |
| JP | 5-297629 | 11/1993 |

(Continued)

OTHER PUBLICATIONS

Japanese Patent Office machine-assisted translation of JP 2001-117271 (pub. Apr. 2001).*

(Continued)

*Primary Examiner*—Janis L. Dote
(74) *Attorney, Agent, or Firm*—Westerman, Hattori, Daniels & Adrian, LLP.

(57) ABSTRACT

A toner for electrophotography fulfilling both the fixability and the void resistance at high level, and forms a high-quality image. The toner for electrophotography contains: a binder resin; and a wax component which contains: a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and substantially not containing a component having 500 Mw or less; and at least any of a second wax having an endothermic peak in a temperature region of 100 to 150° C. and the molecular weight distribution of 5 to 20; and a third wax having an endothermic peak in a temperature region of 150 to 170° C. and the molecular weight distribution of 1.1 or more.

18 Claims, 2 Drawing Sheets

FOREIGN PATENT DOCUMENTS

| | | |
|---|---|---|
| JP | 5-346678 | 12/1993 |
| JP | 5-346684 | 12/1993 |
| JP | 6-89044 | 3/1994 |
| JP | 6-348056 | 12/1994 |
| JP | 7-191492 | 7/1995 |
| JP | 7-234537 | 9/1995 |
| JP | 8-334919 | 12/1996 |
| JP | 10-39535 | 2/1998 |
| JP | 11-38666 | 2/1999 |
| JP | 11-65167 | 3/1999 |
| JP | 11-125929 | 5/1999 |
| JP | 11-125930 | 5/1999 |
| JP | 2000-35689 | 2/2000 |
| JP | 2000-147824 | 5/2000 |
| JP | 2000-155439 | 6/2000 |
| JP | 2001-117271 | 4/2001 |

OTHER PUBLICATIONS

Diamond, A.S., Ed., *Handbook of Imaging Materials*, Marcel Dekker, Inc., NY (1991), pp. 168-169.*

Office Communication from the European Patent Office dated Apr. 16, 2004, in Application No. EP 02 02 3526.

Japanese Notice of Rejection dated Mar. 7, 2006.

Translation of Japanese Notice of Rejection dated Mar. 7, 2006.

* cited by examiner

TONER FOR ELECTROPHOTOGRAPHY AND DEVELOPER FOR ELECTROPHOTOGRAPHY USING THE SAME, PROCESS CARTRIDGE, APPARATUS FOR FORMING IMAGE, AND METHOD FOR FORMING IMAGE

CROSS-REFERENCE TO RELATED APPLICATIONS

This application is based upon and claims priority of Japanese Patent Application No. 2002-077038, filed in Mar. 19, 2002, the contents being incorporated herein by reference.

BACKGROUND OF THE INVENTION

1. Field of the Invention

The present invention relates to a toner for electrophotography to be preferably used for an electrophotographic method performing flash fixing, an electrostatic recording method, a magnetic recording method, or the like, and a developer for electrophotography using the same, a process cartridge using the same, an apparatus for forming an image using the same, and a method for forming an image using the same.

2. Description of the Related Art

In general, for image forming in an electrophotographic system, the following processes are employed: (1) charging a photoconductor electrostatically; (2) exposing the photoconductor to light (formation of a latent image); (3) developing the latent image by a toner; (4) transferring the toner onto a transfer material; (5) fixing the toner onto the transfer material; and other processes. Examples of a method of fixing the toner transferred onto the transfer material may include: a method in which the toner is fused by application of pressure or heat, or by a combination thereof, then solidified and fixed; and a method in which the toner is fused by irradiation with a light energy, then solidified and fixed. Recently, out of these methods, attention has been focused on oven fixing, flash fixing utilizing a flash light, or the like, which will not be detrimentally affected through an application of pressure or heat, from the viewpoint that the method is capable of forming a fine, high-resolution image.

Namely, in these fixing methods, the toner is not required pressure for fixation. This eliminates the problem of offset, or the like, which arises in the case of a fixing roller, or the like. In consequence, these methods advantageously cause less degradation in image resolution (reproducibility) in the fixing step. Further, the toner is not required to be heated by means of a heat source or the like. This eliminates the problem that printing cannot be performed until the heat source (a fixing roller, or the like) will be preheated to a desired temperature upon power-on, or other problems. In consequence, these methods also have an advantage in that printing is possible immediately after power-on. Still further, these methods do not require a high-temperature heat source, and hence are advantageously capable of properly avoiding the temperature rising in the apparatus, or the like. Particularly, the flash fixing method also has the following advantages: even if recording paper is jammed in a fixing unit due to a system malfunction, or in other cases, the recording paper will not burn due to the heat from the heat source; and other advantages.

In general, a color toner has a low light absorption efficiency, resulting in a lower fixability as compared with a black toner. For this reason, a large number of technologies for improving the fixability by adding an infrared absorbent to the toner are proposed in, for example, Japanese Patent Application Laid-Open (JP-A) Nos. 60-63545, 60-63546, 60-57858, 60-57857, 58-102248, 58-102247, 60-131544, 60-133460, and 61-132959, WO 99/13382, JP-A Nos. 2000-147824, 07-191492, 2000-155439, 06-348056, 10-39535, 2000-35689, 11-38666, 11-125930, 11-125928, 11-125929, and 11-65167.

In these cases, however, it is not possible to achieve the compatibility between the fixability and the void resistance in the toner. Herein, the term "void" denotes an image defect uniquely occurring upon performing flash fixing, and a phenomenon that a printed part is left out. The void is caused due to the following reasons. For example, the outermost surface temperature of the toner is increased up to about 500° C. during flash fixing. Accordingly, the toner is fused, so that the air mixed in the toner expands all at once. As a result, the toner is blown off. Moreover, toner particles flocculate upon fusing due to the surface tension of the toner particles. Although the toner viscosity upon fusing is desired to be high in order to prevent the occurrence of the void, a toner having a low toner viscosity is desired for improving the fixability. Therefore, it is difficult to ensure the high-level compatibility between the fixability and the void resistance.

Incidentally, technologies of allowing waxes to be contained in a toner are commonly used in image forming by a heat roll fixing method, and the like. The technologies are disclosed in, for example, Japanese Patent Application Publication (JP-B) Nos. 52-3304, 52-3305, and 57-52574. In these technologies, the waxes are used for improving the offset resistance of the toner for heat roll for example, in Japanese Patent Application Publication (JP-B) No. 52-3305, JP-A Nos. 58-215659, 62-100775, 04-124676, 04-299357, 04-362953, 05-197192, and 08-334919, and the like, there is disclosed a toner containing two or more waxes for the purpose of producing more effects of wax addition over a low-temperature region to a high-temperature region.

However, even if these technologies are directly applied to flash toner as they are, it is not possible to obtain sufficient effects. In the flash fixing system, it has been unable to obtain a toner whose fixability and void resistance have both been implemented at a high level.

SUMMARY OF THE INVENTION

It is therefore an object of the present invention to provide a toner for electrophotography, a developer for electrophotography, a process cartridge, an apparatus for forming an image, and a method for forming an image, whose fixability and void resistance have both been implemented at a high level, and is capable of forming a high-quality image.

The toner for electrophotography of the present invention contains a binder resin and a wax component. Further, the toner for electrophotography of the present invention contains a specific first toner, and at least any of specific second toner and third toner. Therefore, the toner is capable of implementing both the fixability and the void resistance at a high level, and forming a high-quality image.

The developer for electrophotography of the present invention contains the toner for electrophotography of the present invention.

The process cartridge of the present invention at least has: an electrostatic latent image carrier; and means for developing an electrostatic latent image carried on the electrostatic latent image carrier using the toner for electrophotography of the present invention, and forming a visible image.

The apparatus for forming an image of the present invention at least includes: an electrostatic latent image carrier; means for forming an electrostatic latent image on the electrostatic latent image carrier; means for developing the electrostatic latent image using the toner for electrophotography of the present invention, and forming a visible image; means for transferring the visible image onto a recording medium; and means for flash fixing a transfer image formed by the visible image transferred onto the recording medium. In the apparatus for forming an image, the electrostatic latent image forming means forms an electrostatic latent image on the electrostatic latent image carrier. The means for developing holds the toner for electrophotography, and develops the electrostatic latent image to form a visible image. The transfer means transfers the visible image onto a transfer material. The flash fixing means flash fixes a transfer image transferred on the recording medium. As a result, a high-quality image excellent in fixability and void resistance is formed on the recording medium.

The method for forming an image of the present invention at least includes: a step for forming an electrostatic latent image on an electrostatic latent image carrier; a step for developing the electrostatic latent image using the toner for electrophotography of the present invention, and forming a visible image; a step for transferring the visible image onto a recording medium; and a step for flash fixing a transfer image transferred onto a recording medium.

Figure 1:
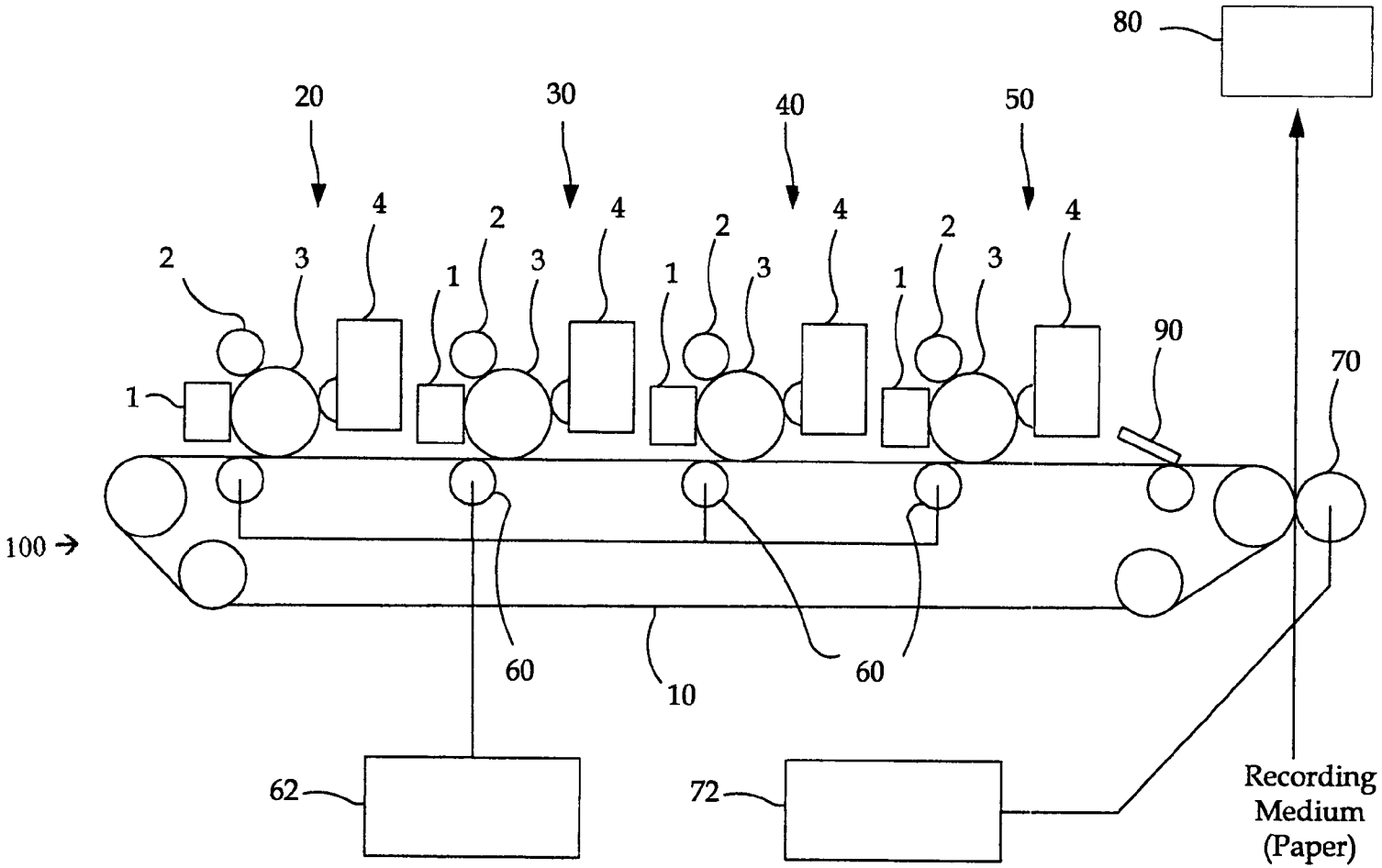
FIG. 1 is a schematic illustrative diagram for showing one example of a method for forming an image of the present invention carried out by the use of an apparatus for forming an image of the present invention.

DESCRIPTION OF THE PREFERRED EMBODIMENTS (Toner for Electrophotography)

The toner for electrophotography contains a binder resin and a wax component, and, if required, it contains appropriately selected colorant, infrared absorbent, charge control agent, and other components.

Binder Resin

The binder resin has no particular restriction, and can be appropriately selected according to the intended purpose. Preferred examples thereof may include polyester.

The polyester has no particular restriction, and can be appropriately selected according to the intended purpose. The one formed without using a soft segment as a raw material is preferred. Particularly preferred polyester has a content of the soft segment of less than 2 mol % in a monomer unit.

If the soft segment is used as the raw material for the polyester, the reaction rate during synthesis of the polyester is slowed. Therefore, unreacted or low-molecular oligomers tend to be formed, so that an odor may occur during flash fixing. Incidentally, as a rough standard of the raw material formulation for synthesis of the polyester, the content of the soft segment in the total monomers of the raw material is preferably 2 mol % or less, and more preferably close to 0 mol %.

The soft segment denotes an alkyl group or an alkenyl group having 5 to 30 carbon atoms. As aliphatic dicarboxylic acids substituted by the soft segment, for example, mention may be made of n-dodecenyl succinate, n-dodecyl succinate, isododecenyl succinate, isododecyl succinate, n-octenyl succinate, and n-octyl succinate. Further, examples of fatty acid diols substituted by the soft segment may include n-dodecenylethylene glycol and n-dodecenyltriethylene glycol.

Although the polyester to be used may be a commercially available one, it can be appropriately synthesized using an acid component and an alcohol component as raw materials.

The acid component has no particular restriction, and can be appropriately selected according to the intended purpose. Examples thereof may include terephthalic acid, isophthalic acid, and orthophthalic acid, and anhydrides thereof. Out of these, terephthalic acid, isophthalic acid, and the like are preferred.

Further, other than the acid component, a tri- or polycarboxylic acid component may be used for the purpose of forming crosslinks in the polyester.

Examples of the tri- or poly-carboxylic acid component may include 1,2,4-benzene tricarboxylic acid, 1,3,5-benzene tricarboxylic acid, and other polycarboxylic acids, and anhydrides thereof.

The alcohol component has no particular restriction, and can be appropriately selected from known ones according to the intended purpose. Preferred examples thereof may include a tri- or more-hydric alcohol component.

Examples of the tri- or poly-hydroxylic alcohol component may include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and other tri- or poly-hydroxylic alcohols.

In the present invention, a bisphenol A alkylene oxide adduct is used preferably in an amount of 80 mol % or more, and more preferably 90 mol % or more, and in particular preferably 95 mol % or more based on the amount of the alcohol component.

If the amount of the bisphenol A alkylene oxide adduct to be used in the alcohol component is less than 80 mol %, the amount of monomers causing the odor to be used may be relatively increased.

As the bisphenol A alkylene oxide adduct, for example, preferably, mention may be made of a compound represented by the following general formula (1):

General Formula (1)

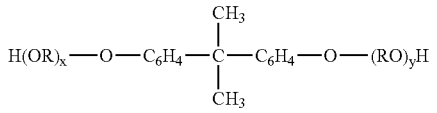

where R expresses an ethylene group or a propylene group; and x and y each expresses an integer of 1 or more.

Specific preferred examples of the bisphenol A alkylene oxide adduct may include:

polyoxypropylene(2.2)-2,2-bis(4-hydroxyphenyl)propane,
polyoxypropylene(3.3)-2,2-bis(4-hydroxyphenyl)propane,
polyoxyethylene(2.0)-2,2-bis(4-hydroxyphenyl)propane,
polyoxyethylene(2.2)-2,2-bis(4-hydroxyphenyl)propane,
polyoxypropylene(2.0)-polyoxyethylene(2.0)-2,2-bis(4-hydroxyphen yl)propane, and polyoxypropylene(6)-2,2-bis(4-hydroxyphenyl)propane.

These may be used alone, or may also be used in combination of two or more thereof. Out of these, polyoxypropylene(2.2)-2,2-bis(4-hydroxyphenyl)propane, polyoxyethylene(2.2)-2,2-bis(4-hydroxyphenyl)propane, polyoxyethylene(2.0)-2,2-bis(4-hydroxyphenyl)propane, and the like are preferred.

When the toner for electrophotography is flash fixed in an image forming process, out of the foregoing bisphenol A alkylene oxide adducts, the compound represented by the foregoing general formula (1) wherein x and y are respectively 1, and R expresses an ethylene group is contained in the alcohol component as the raw material for the polyester preferably in an amount of 60 mol % or more, and more preferably in an amount of 80 mol % or more. The compound represented by the foregoing general formula (1) wherein x and y are respectively 1, and R expresses an ethylene group shows the highest reactivity among the foregoing bisphenol A alkylene oxide adducts. Therefore, use of this compound as a raw material for synthesis of the polyester is advantageous in that the contents of the monomers, dimers, trimers, and the like remaining in the resulting polyester can be reduced.

Incidentally, as methods of reducing the monomers, dimers, trimers, and the like remaining in the resulting polyester, mention may be preferably made of a method in which these reaction accelerators are increased in amount, a method in which the resulting polyester is washed with alcohol, and other methods.

The alcohol to be used for the alcohol washing has no particular restriction, and can be appropriately selected according to the intended purpose. For example, ethanol, methanol, isopropyl alcohol, and the like are preferred in that they are capable of dissolving the monomers, dimers, or the like with ease without dissolving the high molecular weight polyester. Accordingly, the alcohol washing by said alcohols shows a significant result in reducing the residue monomers, dimmers and the like.

For synthesis of the polyester, commonly used esterification catalysts such as zinc oxide, stannous oxide, dibutyltin oxide, dibutyltin dilaurate, and the like can be used for accelerating the synthesis reaction.

In addition to the polyester, styrene-acrylic copolymer, styrene-methacrylic copolymer, polyvinyl chloride, phenol resin, acrylic resin, methacrylic resin, polyvinyl acetate, silicone resins, polyester resins, polyurethane, polyamide resins, furan resins, epoxy resins, xylene resins, polyvinyl butyral, terpene resins, coumarone-indene resins, petroleum resins, polyether polyol resins, or the like may be used in combination as the binder resins.

Although the glass transition temperature (Tg) of the binder resin has no particular restriction, and can be selected according to the intended purpose, it is preferably from about 50 to 70° C.

Wax Component

The wax component contains a first wax, and at least any of a second wax and a third wax, and if required, further contains appropriately selected other waxes.

The first wax is a wax which has an endothermic peak in a temperature region of 60 to 90° C. wherein the endothermic peak occurs in the temperature-rising stage of a DSC curve determined by a differential scanning calorimeter, and has a molecular weight distribution (weight-average molecular weight (Mw)/number-average molecular weight (Mn)) of 1.5 or less, and does not substantially contain a component having a weight-average molecular weight (Mw) of 500 or less.

If the wax component contains the first wax, the fixing strength of the image formed by flash fixing is improved. Further, the first wax does not substantially contain a component having a weight average molecular weight (Mw) of 500 or less. This eliminates the following problems: a part of the wax sublimates, so that an odor occurs upon flash fixing; the life of a desmoking filter for suppressing the odor is reduced; and the like.

Herein, the foregoing wording "the wax component does not substantially contain a component having a weight average molecular weight (Mw) of 500 or less" denotes as follows. The content of the component having a weight average molecular weight (Mw) of 500 or less in the wax component is 1% by mass or less. The content of the component having a weight average molecular weight (Mw) of 500 or less in the wax component is preferably 0.8% by mass or less, and more preferably 0.6% or less.

The temperature region of the endothermic peak in the first wax is preferably from 65 to 85° C., and more preferably from 70 to 80° C. in terms of the fixing strength of an image.

The molecular weight distribution (weight-average molecular weight (Mw)/number-average molecular weight (Mn)) in the first wax is preferably 1.3 or less, and more preferably 1.1 or less, in terms of the fixing strength of an image.

The endothermic peak in the temperature-rising stage of the DSC curve can be determined, for example, by the use of a high-precision inner heat type input compensation model differential scanning calorimeter with a differential thermal analysis method in the following manner. Namely, the temperature at which the endothermic peak is observed can be determined by means of a differential thermal analysis measuring apparatus (DSC measuring apparatus; DSC-7 (manufactured by Perkin-Elmer Co., Ltd)) according to the measuring method of ASTM D3418-82. Incidentally, 5 to 20 mg (preferably 10 mg) of test samples are weighed with precision. Each sample is placed in an aluminium pan, while an empty aluminium pan is used as a reference. The DSC curve is used which is determined when the temperature has been increased at a heating rate of 10° C./min after taking a previous history record by raising and lowering the temperature once.

Further, the molecular weight distribution (weight-average molecular weight (Mw)/number-average molecular weight (Mn)) can be determined, for example, in the following manner. Namely, for the molecular weight distribution, a GPC-150C (manufactured by Waters Corporation) is used as a measuring apparatus, and a GMH-HT 30 cm double-column type (manufactured by Tosoh Corporation) is used as a column. At 135° C., o-dichlorobenzene (0.1% by mass ionol added) solvent is used. Thus, 0.4 ml of a 0.15% by mass sample is injected as a sample at a flow rate of 1.0 ml/min to conduct the measurement. The molecular weight of the sample can be calculated using a molecular weight calibration curve produced based on monodisperse polystyrene standard samples. Further, the calculated value is subjected to polyethylene conversion based on a conversion expression derived from the Mark-Houwink viscosity equation.

The second wax is a wax which has an endothermic peak in the temperature range of 100 to 150° C., the endothermic peak occurring in the temperature-rising stage of the DSC curve determined by a differential scanning calorimeter, and has a molecular weight distribution (weight-average molecular weight (Mw)/number-average molecular weight (Mn)) of 5 to 20.

The third wax is a wax which has an endothermic peak in the temperature range of 150 to 170° C., the endothermic peak occurring in the temperature-rising stage of the DSC curve determined by a differential scanning calorimeter, and has a molecular weight distribution (weight-average molecular weight (Mw)/number-average molecular weight (Mn)) of 1.1 or more. In an embodiment, the molecular weight distribution (weight-average molecular weight (Mw)/number-average molecular weight (Mn)) in the third wax is 2.0 or more.

If at least any of the second wax and the third wax is contained in the wax component, the void resistance of the image by flash fixing is improved.

Since the second wax has a molecular weight distribution (weight-average molecular weight (Mw)/number-average molecular weight (Mn)) of 5 to 20, favorably, voids will not be formed due to dissolution or the like. The molecular weight distribution (weight-average molecular weight (Mw)/number-average molecular weight (Mn)) of the second wax is preferably 5.5 to 19.5, and more preferably 6.0 to 19.0 in terms of void resistance.

The third wax has no particular restriction as to its molecular weight distribution. The wider the molecular weight distribution is, the more preferable it is.

Specific examples of the wax component may include: ester wax, polyethylene wax, polypropylene wax, polypropylene, a copolymeric product of polypropylene and polyethylene, microcrystalline wax, paraffin wax, carnauba wax, Sasol wax, montanic acid ester wax, deoxidized carnauba wax, palmitic acid, stearic acid, montanic acid, brassidic acid, eleostearic acid, unsaturated fatty acids, saturated alcohols, polyhydric alcohols, fatty acid amides, saturated fatty acid bis amides, unsaturated fatty acid amides, aromatic bisamides, fatty acid metal salts (generally referred to as "metallic soaps"), waxes obtained by grafting vinyl monomers such as styrene or acrylic acid to aliphatic hydrocarbon waxes, partially esterified products of fatty acids such as monoglyceride behenate and polyhydric alcohols, and methyl ester compounds having hydroxyl groups obtained by hydrogenating vegetable fats and oils.

Examples of the unsaturated fatty acids may include: palmitic acid, stearic acid, montanic acid, brassidic acid, eleostearic acid, and parinaric acid.

Examples of the saturated alcohols may include: stearyl alcohol, aralkyl alcohol, behenyl alcohol, carnaubyl alcohol, ceryl alcohol, melissyl alcohol, and long-chain alkyl alcohols having longer-chain alkyl groups.

Examples of the polyhydric alcohols may include sorbitol.

Examples of the fatty acid amides may include: linoleic acid amide, oleic acid amide, and lauric acid amide.

Examples of the saturated fatty acid bisamides may include: methylenebis stearic acid amide, ehylene biscaprylic acid amide, ethylene bislauric acid amide, and hexamethylene bisstearic acid amide.

Examples of the unsaturated fatty acid amides may include: ethylene bisoleic acid amide, hexamethylene bis oleic acid amide, N,N'-dioleyl adipic acid amide and N,N'-dioleyl sebacic acid amide.

Examples of the aromatic bisamides may include m-xylene bis stearic acid amide and N,N'-distearyl isophthalic acid amide.

Examples of the fatty acid metal salts may include calcium stearate, calcium laurate, zinc stearate, and magnesium stearate.

These wax components may be used alone, or may also be used in combination of two or more thereof.

The wax component preferably contains all of the first wax, the second wax, and the third wax from the viewpoint of ensuring the high-level compatibility between the fixability and the void resistance. Further, it is particularly preferred that the first wax is selected from the ester waxes each represented by the following general formula, that the second wax is selected from polyethylene waxes, and that the third wax is selected from polypropylene waxes, and waxes of copolymeric products of polyethylene and polypropylene:

[Chemical Formula 4]

$$C—[CH_2—O—CO—(CH_2)_n—CH_3]_4$$

where n is preferably 3 or more, more preferably 9 or more, and in particular preferably 14 or more.

When the first wax is selected from the ester waxes each represented by the foregoing general formula, the second wax is selected from polyethylene waxes, and the third wax is selected from polypropylene waxes, and waxes of copolymeric products of polyethylene and polypropylene, the content of the ester wax in the toner for electrophotography is preferably 0.1 to 5% by mass, and the respective contents of the polyethylene wax, the polypropylene wax, and the wax of copolymeric products of polyethylene and polypropylene are preferably from 0.1 to 1% by mass.

If the content of the ester wax is less than 0.1% by mass, it may be difficult to improve the fixability. On the other hand, if the content of the ester wax exceeds 5% by mass, voids prone to occur, if the respective contents of the polyethylene wax, the polypropylene wax, and the copolymeric product of polyethylene and polypropylene are less than 0.1% by mass, the void resistance may be insufficient. Whereas, if they exceed 1% by mass, the blocking property may be degraded.

If at least three of the ester wax, the polyethylene wax, and the polypropylene wax and the wax of the copolymeric product of polyethylene and polypropylene are used in combination, advantageously, the resulting toner ensures the high-level compatibility between the fixability and the void resistance, and is capable of forming a high-quality image.

Colorant

The colorant has no particular restriction, and can be appropriately selected from known ones according to the intended purpose. Examples thereof may include: yellow colorants, magenta colorants, cyan colorants, black colorants, and the like. Specific examples thereof may include: Carbon Black, Lamp Black, iron black, azurite, nigrosine dye, Aniline Blue, Chalco Oil Blue, DuPont Oil Red, Quinoline Yellow, Methylene Blue Chloride, Phthalocyanine Blue, Phthalocyanine Green, Hansa Yellow, Rhodamine 6C Lake, Chrome Yellow, Quinacridone, Benzidine Yellow, Malachite Green, Malachite Green hexalate, Oil Black, Azo Oil Black, Rose Bengale, Naphthol, Carmine, quinacridone, monoazo dyes, disazo dyes, and trisazo dyes.

Examples of the yellow colorant may include: condensed azo compounds, isoindolinone compounds, anthraquinone compounds, azo metal complexes, methine compounds, and allyl amide compounds. Specific preferred examples thereof may include C.I. pigment Yellow 12, 13, 14, 15, 17, 62, 74, 83, 93, 94, 95, 109, 110, 111, 128, 129, 147, 168, 180, and 185.

Examples of the magenta colorant may include: condensed azo compounds, diketo-pyrrolo-pyrrole compounds, anthraquinone, quinacridone compounds, basic dye lake compounds, naphthol compounds, benzimidazole compounds, thioindigo compounds, and perylene compounds. Specific preferred examples thereof may include: C.I. pigment Red 2, 3, 5, 6, 7, 23, 48:2,48:3, 48:4, 57:1, 81:1, 122, 144, 146, 166, 169, 177, 184, 185, 202, 206, 220, 221, and 254.

Examples of the cyan colorant may include: copper phthalocyanine compounds and derivatives thereof, anthraquinone compounds, and basic dye lake compounds. Specific preferred examples thereof may include: C.I. pigment Blue 1, 7, 15, 15:1, 15:2, 15:3, 15:4, 60, 62, and 66.

These colorants may be used alone, or may also be used in combination of two or more thereof. Further, it may also be used in solid solution.

The content of the colorant in the color toner for electrophotography is preferably from 0.1 to 20% by mass, and more preferably from 0.5 to 10% by mass.

Infrared Absorbent

As the infrared absorbent, any material may be used so long as it has at least one or more intense light absorption peaks in the near-infrared region at 750 to 1200 nm. It may be either of an inorganic infrared absorbent or an organic infrared absorbent.

Examples of the inorganic infrared absorber may include lanthanoid compounds such as ytterbium oxide and ytterbium phosphate, indium tin oxide, and tin oxide.

Examples of the organic infrared absorbent may include aminium compounds, diimonium compounds, naphthalocyanine compounds, cyanine compounds, and polymethine compounds.

These may be used alone, or may also be used in combination of two or more thereof.

The content of the infrared absorbent in the toner for electrophotography is preferably from 0.1 to 1.5% by mass, and more preferably from 0.3 to 1% by mass.

If the content is less than 0.1% by mass, the resulting toner for electrophotography may not be fixed. Whereas, if it exceeds 1.5% by mass, the color of the image to be formed may become dull.

Charge Control Agent

The charge control agent has no particular restriction, and can be appropriately selected from known ones according to the intended purpose. Examples thereof may include: calixarenes, nigrosine dyes, quaternary ammonium salts, amino group-containing polymers, metal-containing azo dyes, salicylic acid complex compounds, phenol compounds, azo chromium compounds, azo zinc compounds, triphenylmethane derivatives, and zinc naphthoate complex.

These may be used alone, or may also be used in combination of two or more thereof.

Other Components

The other components have no particular restriction, and can be appropriately selected from known ones according to the intended purpose. Examples thereof may include: flow improvers, cleaning activators, magnetic materials, fixing adjuvant, metallic soaps, and surfactants.

The flow improvers have no particular restriction, and can be appropriately selected from known ones according to the intended purpose. Examples thereof may include inorganic fine particles such as white particles.

Examples of the inorganic fine particles may include: silica fine particles, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

These may be used alone, or may also be used in combination of two or more thereof. Out of these, silica fine particles are preferred. Silica fine particles, the titanium compound, resin fine particles, alumina, and the like are also preferably used in combination.

The content of the flow improver in the toner for electrophotography is preferably from 0.01 to 5% by mass, and more preferably from 0.01 to 2.0% by mass.

The cleaning activator has no particular restriction, and can be appropriately selected from known ones according to the intended purpose. Examples thereof may include metallic salts of higher fatty acids typified by zinc stearate, or the like, fine-particle powders of fluorinated high molecular polymer.

The magnetic materials have no particular restriction, and can be appropriately selected from known ones according to the intended purpose. Examples thereof may include: iron powder, magnetite, and ferrite. Particularly, when the toner for electrophotography of the present invention is a color toner, white magnetic powder is preferably used in terms of color tone.

Examples of the surfactants may include non-ionic surfactants.

In the toner for electrophotography of the present invention, the content of the component having a weight-average molecular weight (Mw) of 500 or less is preferably 4% by mass or less, more preferably 3% by mass or less, and further preferably 2% by mass or less.

If the content is 4% by mass or less, the amount of the low-molecular-weight component of the binder resin itself is controlled, so that the occurrence of an odor upon fixing is effectively controlled.

Incidentally, it is possible to determine the content of the component having a weight-average molecular weight (Mw) of 500 or less in the following manner. Namely, the toner for electrophotography is dissolved in tetrahydrofuran, followed by filtration through a 0.2 μm membrane filter. Thereafter, the molecular weight distribution of the toner component for electrophotography dissolved in tetrahydrofuran is determined by a differential refractometer by means of a GPC apparatus (HLC-8120GPC (manufactured by Tosoh Co., Ltd.)). Thus, by determining the ratios of the components with respective molecular weights from a calibration curve, it is possible to check the content by weight of the components each with a molecular weight of 500 or less. For this measurement, as the column, a combination of two connected columns TSK gel Super HM-M (Tosoh) (500 to 106) is used. As the filler, a filler containing styrene-divinylbenzene gel as a main component is used. As the guard column, TSK guard column Super H-H (Tosoh) is used. Thus, tetrahydrofuran with a sample concentration of 0.1% by weight is flowed therethrough at a flow rate of 0.6 ml/min. Under such conditions, the measurement was carried out by using a three-dimensional expression calibration curve by standard polystyrenes (370 to 289000).

A method of manufacturing the toner for electrophotography has no particular restriction, and can be appropriately selected from known methods according to the intended purpose. For example, mention may be made of the following mechanical grinding method, and the like. Namely, the binder resin, the wax component, the colorant (such as a pigment), the infrared absorbent, the charge control agent, the magnetic materials, and the like are mixed by means of a mixing device such as a ball mill or a HENSCHEL MIXER mixer. Then, the resulting mixture is melt-kneaded, and milled by means of a heat kneading machine such as a heating roll, a kneader, or an extruder to make the resins compatible with each other. Then, the metal compound, pigment, dye, magnetic material, and the like are dispersed or dissolved, followed by cooling for solidification. Thereafter, the solidified mixture is ground by means of a grinding machine such as a jet mill, and the resulting particles are classified into a desired particle diameter to manufacture toner particles. With this method, in order for two or more wax components to be contained therein, a method in which waxes are previously fused and mixed with stirring at the wax melting temperature or a higher temperature, and cooled and solidified, followed by grinding, and then added, or other methods are preferred. However, the wax component may be kneaded as the toner material together with other materials during kneading of the toner. Further, if required, a desired additive may be sufficiently mixed by means of a mixing apparatus such as a HENSCHEL MIXER.

The toner for electrophotography of the present invention is preferable for a developer for electrophotography, a process cartridge, an apparatus for forming an image, and a method for forming an image to be used for an image forming process by an electrophotographic method. In particular, it can be preferably used for the following developer for electrophotography, process cartridge, apparatus for forming an image, and method for forming an image of the present invention.

(Developer for Electrophotography)

The developer for electrophotography of the present invention at least contains the toner for electrophotography of the present invention, and contains appropriately selected other components.

The developer for electrophotography may be a one-component developer made of the toner for electrophotography, or may also be a two-component developer containing the toner for electrophotography and a carrier. However, when it is used for a high-speed printer adaptable to a recent improvement in information processing speed, or the like, the two-component developer is preferred in terms of improvement in life, and the like.

The developer for electrophotography of the present invention may be implemented in any of the aspects of monochrome, two to three colors, and full four colors.

Carrier

The carrier has no particular restriction, and can be appropriately selected according to the intended purpose. The ones each having a core material and a resin layer covering the core material are preferred.

Preferred examples of the material for the core material may include 50 to 90-emu/g manganese-strontium (Mn—Sr) materials and manganese-magnesium (Mn—Mg) materials. High magnetization materials such as iron powder (100 emu/g or more), magnetite (75 to 120 emu/g), and ferrite are preferred from the viewpoint of ensuring the image concentration. Low magnetization materials such as copper-zinc (Cu—Zn) (30 to 80 emu/g) are preferred in that the resulting carrier can more softly touch the photoconductor on which the toner particles are arranged in a chain, which is advantageous for enhancing the quality of the image. These may be used alone, or may also be used in combination with two or more thereof.

The particle diameter of the core material is preferably from 10 to 150 μm, and more preferably 40 to 100 μm in average particle diameter (volume average particle diameter ($D_{50}$)).

If the average particle diameter (volume average particle diameter ($D_{50}$)) is less than 10 μm, particles of a fine-powder type are increased in amount in the distribution of carrier particles. As a result, the magnetization per particle lowers, which may cause scattering of carrier particles. If it exceeds 150 μm, the specific surface area decreases, which may cause scattering of toner particles. Thus, for a full-color image rich in filled-in portions, particularly, the filled-in portions may be reproduced poorly.

The materials for the resin layer has no particular restriction, and can be appropriately selected from known materials according to the intended purpose. Preferred examples thereof from the viewpoints of the durability and the long-life property may include: silicone resin, acrylic-modified silicone resins, and fluorine-modified silicone resins and the like. These may be used alone, or may also be used in combination with two or more thereof.

The resin layer can be formed in the following manner. For example, the silicone resin, or the like is dissolved in a solvent to prepare a coating solution. Then, the coating solution is uniformly coated on the surface of the core material by a known coating method such as a dipping method, a spray method, or a brushing method. The applied coating solution is dried, followed by burning, or the like.

The solvent has no particular restriction, and can be appropriately selected according to the intended purpose. Examples thereof may include: toluene, xylene, methyl ethyl ketone, methyl isobutyl ketone, and butyl cellosolve acetate.

The burning may be accomplished by an external heating method, or an internal heating method, examples of which may include: a method using a fixed-type electric furnace, a fluid-type electric furnace, a rotary-type electric furnace, a burner furnace, or the like and a method using a microwave.

The proportion of the resin layer in the carrier (resin coating amount) is preferably from 0.01 to 5.0% by mass based on the total amount of the carrier.

If the proportion (resin coating amount) is less than 0.01% by mass, it may be difficult to form the resin layer uniformly on the surface of the core material. If it exceeds 5.0% by mass, the resulting resin layer may be too thick, so that granulation occurs among carrier particles. As a result, it may be difficult to obtain uniform carrier particles.

When the developer for electrophotography is the two-component developer, the content of the carrier in the two-component developer has no particular restriction, and can be appropriately selected according to the intended purpose. For example, it is preferably more than 50% by mass and less than 99% by mass, and more preferably more than 90% by mass and less than 97% by mass (i.e., the content of the toner for electrophotography in the two-component developer is preferably from 1 to 50% by mass, and more preferably 3 to 10% by mass).

The developer for electrophotography of the present invention can be preferably used for image forming by various known electrophotographic methods such as a magnetic one-component developing method, a non-magnetic one-component developing method, and a two-component developing method. In particular, it can be preferably used for the following process cartridge, apparatus for forming an image, and method for forming an image of the present invention.

(Process Cartridge)

A process cartridge of the present invention is a component detachable to an apparatus for forming an image of the present invention, described later. It at least has a carrier for carrying an electrostatic latent image, means for developing the electrostatic latent image carried on the electrostatic latent image carrier using a developer, and forming a visible image.

The developing means at least has a developer container for holding the toner for electrophotography or the developer for electrophotography of the present invention, and a developer carrier for holding and carrying the toner for electrophotography or the developer for electrophotography held in the developer container. Therefore, particularly, by mounting the process cartridge in the apparatus for forming an image of the present invention described later, it is possible to form a high-quality image excellent in fixability and void resistance.

(Method for Forming an Image and Apparatus for Forming an Image)

A method for forming an image of the present invention includes at least, a step for forming an electrostatic latent image on an electrostatic latent image carrier; a step for developing the electrostatic latent image using the developer for electrophotography of the present invention, and forming a visible image; a step for transferring the visible image onto a recording medium; and a step for flash fixing the transfer image transferred onto the recording medium.

A apparatus for forming an image of the present invention includes at least, an electrostatic latent image carrier; means for forming an electrostatic latent image on the electrostatic latent image carrier; means for developing the electrostatic latent image using the developer for electrophotography of the present invention, and forming a visible image; means for transferring the visible image onto a recording medium; and means for flash fixing the transfer image transferred onto the recording medium.

The method for forming an image of the present invention includes, as described above, a step for forming an electrostatic latent image, a step for developing, a step for transferring, and a step for flash fixing. If required, it may also include appropriately selected other steps such as a step for charge elimination, a step for cleaning, a step for recycling, and a step for controlling.

The apparatus for forming an image of the present invention includes, as described above, an electrostatic latent image carrier, means for forming and electrostatic latent image, means for developing, means for transferring, and means for flash fixing. If required, it may also include appropriately selected other means such as means for charge eliminating, means for cleaning, means for recycling, and means for controlling.

The method for forming an image of the present invention can be preferably carried out by the apparatus for forming an image of the present invention. The electrostatic latent image forming step can be carried out by the electrostatic latent image forming means. The step for developing can be carried out by the means for developing. The step for transferring can be carried out by the means for transferring. The step for flash fixing can be carried out by the means for flash fixing. The other steps can be carried out by the other means.

Step for Forming Electrostatic Latent Image and Means for Forming Electrostatic Latent Image The step for forming electrostatic latent image is a step for forming an electrostatic latent image on an electrostatic latent image carrier.

The electrostatic latent image carrier (may be referred to as a "photoconductive insulator", or "photoconductor") has no particular restriction as to the material, shape, structure, size, quality of material, and the like, and can be appropriately selected from known ones. As the shape, mention may be preferably made of a drum-like shape. Examples of the material may include: inorganic photoconductors such as amorphous silicon and selenium, and organic photoconductors such as polysilane and phthalopolymethine. Out of these, amorphous silicon, and the like are preferred in terms of long-life property.

The electrostatic latent image can be formed in the following manner. For example, the surface of the electrostatic latent image carrier is uniformly charged, followed by imagewise exposure. This can be carried out by the means for forming electrostatic latent image.

The means for forming electrostatic latent image includes at least a charger for uniformly charging the surface of the electrostatic latent image carrier, and an exposing unit for imagewise exposing the surface of the electrostatic latent image carrier.

The charging can be accomplished by, for example, applying the surface of the electrostatic latent image carrier with a voltage by the use of the charger.

The charger has no particular restriction, and can be appropriately selected according to the intended purpose. Examples thereof may include: contact chargers known themselves including conductive or semiconductive roll, brush, film, rubber blade, and the like, and non-contact chargers utilizing corona discharge, such as a corotron and a scorotron.

The exposure can be accomplished by, for example, imagewise exposing the surface of the electrostatic latent image carrier by the use of the exposing unit.

The exposing unit has no particular restriction so long as it is capable of exposing the surface of the electrostatic latent image carrier charged by the charger to light in the pattern corresponding to the image to be formed. It can be appropriately selected according to the intended purpose. Examples thereof may include various exposing units such as a copying optical system, a rod lens array system, a laser optical system, and a liquid crystal shutter optical system.

Incidentally, in the present invention, an optical back process may also be adopted in which the electrostatic latent image carrier is imagewise exposed from its back side.

Step for Developing and Means for Developing

The step for developing is a step for developing the electrostatic latent image using the toner for electrophotography or the developer for electrophotography of the present invention, and forming a visible image.

The visible image can be formed by, for example, developing the electrostatic latent image using the toner for electrophotography or the developer for electrophotography of the present invention, and the formation can be accomplished by the means for developing.

The means developing has at least a developing unit for holding the toner for electrophotography or the developer for electrophotography, and supplying the toner for electrophotography or the developer for electrophotography to the electrostatic latent image in a contact or non-contact manner.

The developing unit may be of a dry development system, or it may also be of a wet development system. Alternatively, it may be a developing unit for monochrome, or it may also be a developing unit for multicolor. Preferred examples thereof may include the one having a stirrer for friction-stirring and charging the toner for electrophotography or the developer for electrophotography, and a rotatable magnet roller.

In the developing unit, for example, the toner for electrophotography and the carrier are mixed with stirring. The toner for electrophotography is charged due to the friction at this step, and held in a chain on the surface of the rotating magnet roller to form a magnetic brush. The magnet roller is placed in the vicinity of the electrostatic latent image carrier (photoconductor). Therefore, a part of the toner for electrophotography constituting the magnetic brush formed on the surface of the magnet roller moves onto the surface of the electrostatic latent image carrier (photoconductor) by the electric attraction force. As a result, the electrostatic latent image is developed by the toner for electrophotography, so that a visible image by the toner for electrophotography is formed on the surface of the electrostatic latent image carrier (photoconductor).

The developer to be held in the developing unit is the developer for electrophotography containing the toner for electrophotography of the present invention. The developer for electrophotography may be a one-component developer or may also be a two-component developer. The toner to be contained in the developer for electrophotography is the toner for electrophotography of the present invention.

Step for Transferring and Means for Transferring

The step for transferring is a step for transferring the visible image onto a recording medium. In accordance with a preferred aspect thereof, the step includes a first transfer step for transferring a lowermost layer visible image and an upper layer visible image in this order onto an intermediate transfer member, and forming a composite transfer image; and a second transfer step for transferring the composite transfer image on a recording medium so that the lowermost layer visible image in the composite transfer image is situated immediately on the recording medium.

The transfer of the visible image can be carried out by charging the electrostatic latent image carrier (photoconductor) by using a transfer charger, and this process can be accomplished by the transfer means. In accordance with a preferred aspect thereof, the transfer means includes a first transfer means for transferring a lowermost layer visible image and an upper layer visible image in this order onto an intermediate transfer member, and forming a composite transfer image; and a second transfer means for transferring the composite transfer image on a recording medium so that the lowermost layer visible image in the composite transfer image is situated immediately on the recording medium.

Incidentally, the intermediate transfer member has no particular restriction, and can be appropriately selected from known transfer members according to the intended purpose.

Incidentally, for the transfer, a black toner image is irrelevant to the color reproducibility in color superimposition, and hence it can be transferred in a given turn. However, it is preferably transferred in the final turn from the viewpoint of black component generation.

The means for transferring (the first transfer means, the second transfer means) has at least a transfer unit for charging the visible image formed on the electrostatic latent image carrier (photoconductor), and peeling it, and transferring it onto the recording medium side. The number of the means for transferring may be one, or may also be two or more.

Examples of the transfer unit may include: a corona transfer unit by corona discharge, a transfer belt, a transfer roller, a pressure transfer roller, and an adhesion transfer roller.

Incidentally, the recording medium has no particular restriction, and can be appropriately selected from known recording media (recording paper).

Step for Flash Fixing and Means for Flash Fixing

The step for flash fixing is a step for flash fixing the visible image transferred onto the recording medium by means of a flash light fixing apparatus. The image of each toner for electrophotography may be flash fixed every time it is transferred onto the recording medium. Alternatively, the images of respectively toner for electrophotography may also be flash fixed simultaneously at a time in a superimposed manner.

The optical energy for the flash fixing (may also be referred to as "flash energy") is preferably about 1 to 3 J/cm$^2$ per color of the color toner. When images of four colors are fixed all together, the light energy is preferably about 2 to 7 J/cm$^2$, and more preferably about 3 to 5 J/cm$^2$.

If the light energy falls short of the numeric value range, the fixing may not be carried out favorably. On the other hand, if it exceeds the numeric value range, a toner void, a burn of paper, and the like may occur.

The flash fixing can be accomplished by, for example, irradiating the visible image transferred onto the recording medium with light by means of a flash fixing unit, and can be carried out by the means for flash fixing.

The means for flash fixing has at least a flash fixing unit (flash lamp) for emitting an infrared ray. The number of the means for flash fixing may be one, or may also be two or more.

The flash fixing unit (flash lamp) has no particular restriction, and can be appropriately selected according to the intended purpose. Preferred examples thereof may include an infrared lamp and a xenon lamp.

The wavelength of emitting light by the means for flash fixing in the step for flash fixing is preferably close to the absorption wavelength of the infrared absorbent to be used.

The light energy (J/cm$^2$) per unit area for every flash light denoting the intensity of light emission by the flash fixing unit (flash lamp) can be calculated from the following equation (1):

$$S=((1/2)\times C\times V^2)/(u\times l)/(n\times f), \quad (1)$$

wherein "n" expresses the number of the lamps; "f", the lightening frequency (Hz); "V", the input voltage (V); "C" the capacitor capacity (μF): "u", the process carrying rate (mm/s); "l", the printing width (mm); and "S", the energy density (J/cm$^2$).

Incidentally, in the present invention, for example, a known fixing unit such as a heat roller fixing unit can be used together with, or in place of the step for flash fixing and the means for flash fixing according to the intended purpose.

The step for charge eliminating is a step for applying the electrostatic latent image carrier with a discharge bias, and eliminating charges, and can be preferably carried out by means for charge eliminating.

The means for charge eliminating has no particular restriction so long as it is capable of applying the electrostatic latent image carrier with a discharge bias. It can be appropriately selected from known charge eliminators. Preferable examples thereof may include a discharge lamp.

The step for cleaning is a step for removing the toner for electrophotography remaining on the electrostatic latent image carrier, and can be preferably carried out by the means for cleaning.

The means for cleaning has no particular restriction so long as it is capable of removing the toner for electrophotography remaining on the electrostatic latent image carrier. It can be appropriately selected from known cleaners. Examples thereof may include: a magnetic brush cleaner, an electrostatic brush cleaner, a magnetic roller cleaner, a blade cleaner, a brush cleaner, and a web cleaner.

The step for recycling is a step for recycling the color toner for electrophotography removed by the step for cleaning to the means for developing, and can be preferably carried out by the means for recycling.

The means for recycling has no particular restriction. Examples thereof may include known carrying means.

The step for controlling is a step for controlling the respective steps, and can be preferably carried out by means for controlling.

The means for controlling has no particular restriction so long as it is capable of controlling the motion of each of the means. It can be appropriately selected according to the intended purpose. Examples thereof may include: instruments such as a sequencer and a computer.

One example in which the method for forming an image of the present invention is carried out by using the apparatus for forming an image of the present invention will be described by reference to FIG. 1. As shown in FIG. 1, an apparatus for forming an image 100 includes: an intermediate transfer member 10, a black developing unit 20, a cyan developing unit 30, a magenta developing unit 40, a yellow developing unit 50, first transfer means 60, a second transfer means 70, a flash fixing means 80, and a cleaning means 90.

The intermediate transfer member 10 is a rotary belt, and rotatably disposed in a stretched manner by four rotary rollers. In the outer periphery thereof, the black developing unit 20, the cyan developing unit 30, the magenta developing unit 40, the yellow developing unit 50, and the second transfer means 70 are placed in this order in opposed relation to the intermediate transfer member 10. The intermediate transfer member 10 rotates from the side of the second transfer means 70 in the direction toward the black development unit 20. Incidentally, the second transfer means 70 is a transfer charging unit, and is drivable by a second transfer electric potential supply means 72.

In the inner periphery of the intermediate transfer member 10, the four first transfer means 60 are disposed in opposed relation to the black development unit 20, the cyan development unit 30, the magenta development unit 40, and the yellow development unit 50. Incidentally, the first transfer means 60 are transfer chargers, and is drivable by the first transfer electric potential supply means 62.

Each of the black development unit 20, the cyan development unit 30, the magenta development unit 40, and the yellow development unit 50 is a development unit including a charging means 1, an exposure means 2, an electrostatic latent image carrier (photoconductor) 3, and a developing means 4. Out of these, the electrostatic latent image carrier (photoconductor) 3 is disposed in opposed relation to the outer periphery of the intermediate transfer member 10. Then, around the electrostatic latent image carrier (photoconductor) 3, the charging means 1, the exposure means 2, and the development unit 4 are placed in opposed relation to the electrostatic latent image carrier (photoconductor) 3.

With the apparatus for forming an image 100, an image can be formed in the following manner. First, in the black development unit 20, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the black image to be formed. As a result, a black electrostatic latent image is formed on the electrostatic latent image carrier (photoconductor) 3. Then, the developing means 4 supplies the black toner held therein onto the black electrostatic latent image, and thereby develops it to form a black visible image.

Then, in the cyan development unit 30, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the cyan image to be formed. As a result, a cyan electrostatic latent image is formed on the electrostatic latent image carrier (photoconductor) 3. Then, the developing means 4 supplies the cyan toner held therein onto the cyan electrostatic latent image, and thereby develops it to form a cyan visible image.

Then, in the magenta development unit 40, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the magenta image to be formed. As a result, a magenta electrostatic latent image is formed on the electrostatic latent image carrier (photoconductor) 3. Then, the developing means 4 supplies the magenta toner held therein onto the magenta electrostatic latent image, and thereby develops it to form a magenta visible image.

Then, in the yellow development unit 50, the charging means 1 uniformly charges the surface of the electrostatic latent image carrier (photoconductor) 3. Then, the exposure means 2 exposes the surface of the electrostatic latent image carrier (photoconductor) 3 to light in a pattern corresponding to the same image as the yellow image to be formed. As a result, a yellow electrostatic latent image is formed on the electrostatic latent image carrier (photoconductor) 3. Then, the developing means 4 supplies the yellow toner held therein onto the yellow electrostatic latent image, and thereby develops it to form a yellow visible image.

Then, the black visible image, the cyan visible image, the magenta visible image, and the yellow visible image formed on the respective electrostatic latent image carriers (photoconductors) 3 in the black developing unit 20, the cyan developing unit 30, the magenta developing unit 40, and the yellow developing unit 50 are sequentially transferred and superimposed one on another onto the intermediate transfer member 10 in this order by the action of the transfer potentials resulting from the respective first transfer means 60. In consequence, a full-color transfer image by black, cyan, magenta, and yellow is formed.

Then, the transfer images are transferred at a time in this order onto a recording medium by the action of the transfer potential resulting from the second transfer means 70. In consequence, a full-color transfer image by black, cyan, magenta, and yellow is formed on the recording medium. Incidentally, at this step, the toners are stacked in the order of yellow, magenta, cyan, and black from the recording medium side in the resulting transfer image.

Then, the transfer image formed on the recording medium is carried to the flash fixing means 80, where it is irradiated with light from the flash fixing means 80 there to be fused. In consequence, it is fixed on the recording medium. In this manner, the composite transfer image is firmly fixed on the recording medium to form a full-color image by the composite transfer image.

Incidentally, the toner remaining on the intermediate transfer member 10 is removed by a cleaning blade as the cleaning means 90.

In accordance with the apparatus for forming an image or the method for forming an image of the present invention, it is possible to effectively form a high-quality image while ensuring the high-level compatibility between the fixability and the void resistance.

Below, the present invention will be described by way of examples and comparative examples, which should not be construed as limiting the scope of the present invention.

(Syntheses of Polyesters A to C)

25 mol of polyoxypropylene(2.2)-2,2-bis(4-hydroxyphenyl)propane, 25 mol of polyoxyethylene(2.2)-2,2-bis(4-hydroxyphenyl)propane, 25 mol of terephthalic acid, 25 mol of isophthalic acid, and 5.0 g of dibutyl tin oxide were charged into a 4-necked flask made of glass. The flask was equipped with a thermometer, a stainless steel stirrer, a falling condenser, and a nitrogen inlet tube. Thus, the reaction was effected in a mantle heater under a flow of nitrogen at 220° C. for 15 hours, and at 240° C. for 15 hours, and further at the same temperature under a reduced pressure of 60 mmHg for 2 hours to complete the reaction. As a result, polyesters A to C with respective compositions shown in Table 1 were synthesized.

TABLE 1

| | Raw material monomer | Polyester A | Polyester B | Polyester C |
|---|---|---|---|---|
| Acid component (molar ratio) | Terephthalic acid | 25 | 25 | 25 |
| | Isophthalic acid | 25 | 25 | 25 |
| | Trimellitic anhydride | 0.01 | 0.01 | 0.01 |
| Alcohol component (molar ratio) | BPA-PO | 25 | 24 | 19 |
| | BPA-EO (2.2) | 25 | 24 | 19 |
| | Ethylene glycol | — | 2 | 12 |
| Temperature and Reaction time | ° C. × Time | 220° C. × 15 hours + 240° C. × 15 hours | 220° C. × 15 hours + 240° C. × 15 hours | 220° C. × 15 hours + 240° C. × 15 hours |

EXAMPLES 1 TO 16 AND COMPARATIVE EXAMPLES 1 TO 14

Manufacturing of Toner for Electrophotography

Based on Tables 2 to 4, each toner composition was put into a HENSCHEL MIXER, and pre-mixed. Then, the resulting mixture was knead by an extruder with intensive degassing, and was roughly ground by a hammer mill, followed by fine grinding by a jet mill. The resulting particles were classified by an air classifier to obtain colored fine particles with a volume average particle diameter (D50) of 8.5±0.5 μm. Subsequently, 0.5 parts by mass of hydrophobic silica fine particles (R974, manufactured by Japan Aerosil Co.,) were subjected to an external addition process by a HENSCHEL MIXER. In consequence, each toner for electrophotography was manufactured.

Image Forming

By using each of the resulting toners, an image was formed on plain paper (NIP-1500LT, manufactured by Kobayashi Kirokushi Co., Ltd.,) by means of a GL8300 printer (manufactured by Fujitsu Limited) with the structure schematically shown in FIG. 1.

Figure 2:
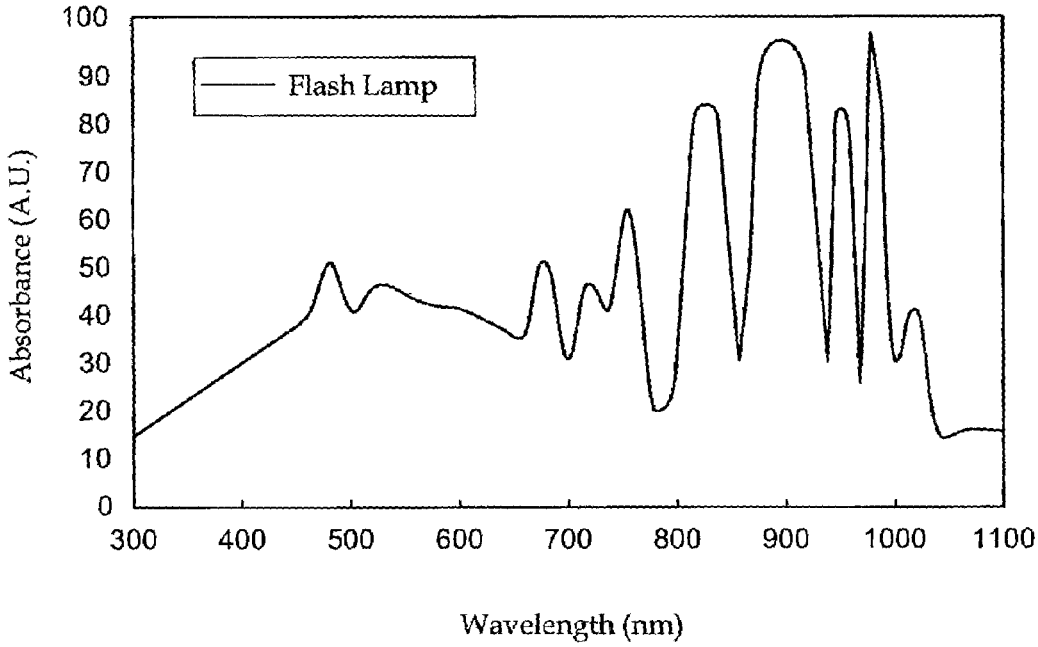
FIG. 2 is a graph showing the light emission waveform of a flash fixing unit.

Incidentally, as the flash fixing means 80 in the apparatus for forming an image 100 schematically shown in FIG. 1, there was used a flash (flash lamp) fixing device in a flash printer PS2160 (manufactured by Fujitsu Limited). Further, the light emission waveform of the flash (flash lamp) fixing device is shown in FIG. 2. The optical energy of the flash (flash lamp) fixing device was found to be 3.5 J/cm$^2$.

(Fixability Evaluation (Tape Peeling Test))

The image status concentration on plain paper on which each of the images was formed was determined. Then, a peelable tape (trade name "SCOTCH MENDING TAPE" (manufactured by Sumitomo 3M Co., Ltd.)) was adhered onto the toner image on plain paper. Then, the peelable tape was peeled off to determine the status concentration on plain paper after peeling again. Thus, the image printing concentration (%) on plain paper after peeling was defined as the toner fixing ratio when the image printing concentration on plain paper before peeling off the peelable tape was set to be 100. Thus, evaluation was carried out in accordance with the following evaluation criteria.

When the fixing ratio is less than 70% . . . X When the fixing ratio is 70% or more, and less than 80% . . . Δ

When the fixing ratio is 80% or more, and less than 90% . . . ○

When the fixing ratio is 90% or more . . . ◎

It is noted that a spectrometer (938 Spectrodentitometer (manufactured by X-Rite Co.)) was used for determining the status concentration. In the following evaluation criteria, the practical level is 80% or more. The results are shown in Tables 2 to 4.

(Evaluation of Void)

Each of the resulting images was observed under an optical microscope, and evaluated according to the following evaluation criteria. The results are shown in Tables 2 to 4.

When occurrence of voids is apparently observed . . . X

When a few voids are observed under the standard conditions (the amount of toner deposited is 0.6 mg/cm$^2$), but they cannot be observed visually . . . Δ

When no void is observed under the standard conditions (the amount of toner deposited is 0.6 mg/cm$^2$) . . . ○

When no void is observed even if the amount of toner deposited is 0.9 mg/cm$^2$ or more . . . . ◎

(Evaluation of Odor Upon Flash Fixing)

The sensory evaluation was carried out on the odor generated upon formation of the image by 10 panelists. Evaluation was carried out based on the following evaluation criteria. The results are shown in Tables 2 to 4.

When 8 or more panelists have judged that the odor is not present . . . ◎

When 6 to 7 panelists have judged that the odor is not present . . . ○

When 5 or less panelists have judged that the odor is not present . . . X (Resolution Evaluation)

Each resulting image was checked for the presence or absence of a brush mark characteristic of a two-component developer to evaluate the resolution based on the following evaluation criteria. The results are shown in Tables 2 to 4.

When no brush mark is observed even by microscopic observation . . . ◎

When no brush mark is observed even by visual observation . . . ○

When some brush marks are observed by visual observation . . . Δ

TABLE 2

| Item | Example/Comparative Example | | Comp. Ex. 1 | Comp. Ex. 2 | Comp. Ex. 3 | Comp. Ex. 4 | Ex. 1 | Ex. 2 | Ex. 3 | Ex. 4 | Comp. Ex. 5 | Comp. Ex. 6 | Comp. Ex. 7 |
|---|---|---|---|---|---|---|---|---|---|---|---|---|---|
| Material | Cyan pigment | Blue B2G | 4 | 4 | 4 | 4 | 4 | 4 | 4 | 4 | 4 | 4 | 4 |
| | Binder resin | Polyester A (no soft segment) | 92.5 | 92.5 | 92.5 | 92.5 | 92.5 | 92.5 | 92.5 | 92.5 | 92.5 | 92.5 | 92.5 |
| | | Polyester B (soft segment 2 mol %) | — | — | — | — | — | — | — | — | — | — | — |
| | | Polyester B (soft segment 12 mol %) | — | — | — | — | — | — | — | — | — | — | — |
| | Charge control agent | E-89 (calixanrene, Orient) | 1 | 1 | 1 | 1 | 1 | 1 | 1 | 1 | 1 | 1 | 1 |
| | Infrared absorbent | SIR-130 | 0.5 | 0.5 | 0.5 | 0.5 | 0.5 | 0.5 | 0.5 | 0.5 | 0.5 | 0.5 | 0.5 |
| | Wax | Wax A-1 | — | — | — | — | — | — | — | — | — | — | — |
| | | Wax A-2 | — | — | — | — | — | — | — | — | — | — | — |
| | | Wax A-3 | — | — | — | — | — | — | — | — | — | — | — |
| | | Wax A-4 | 1 | 1 | 1 | 1 | 1 | 1 | 1 | 1 | 1 | 1 | 1 |
| | | Wax A-5 | — | — | — | — | — | — | — | — | — | — | — |
| | | Wax A-6 | — | — | — | — | — | — | — | — | — | — | — |
| | | Wax B-1 | 1 | — | — | — | — | — | — | — | — | — | — |
| | | Wax B-2 | — | 1 | — | — | — | — | — | — | — | — | — |
| | | Wax B-3 | — | — | 1 | — | — | — | — | — | — | — | — |
| | | Wax B-4 | — | — | — | 1 | — | — | — | — | — | — | — |
| | | Wax B-5 | — | — | — | — | 1 | — | — | — | — | — | — |
| | | Wax B-6 | — | — | — | — | — | 1 | — | — | — | — | — |
| | | Wax B-7 | — | — | — | — | — | — | 1 | — | — | — | — |
| | | Wax B-8 | — | — | — | — | — | — | — | 1 | — | — | — |
| | | Wax B-9 | — | — | — | — | — | — | — | — | 1 | — | — |
| | | Wax B-10 | — | — | — | — | — | — | — | — | — | 1 | — |
| | | Wax B-11 | — | — | — | — | — | — | — | — | — | — | 1 |
| | | Wax C-1 | — | — | — | — | — | — | — | — | — | — | — |
| | | Wax C-2 | — | — | — | — | — | — | — | — | — | — | — |
| | | Wax C-3 | — | — | — | — | — | — | — | — | — | — | — |
| | | Wax C-4 | — | — | — | — | — | — | — | — | — | — | — |
| | Fixability | | ◎ | ◎ | ◎ | ◎ | ◎ | ◎ | ◎ | ◎ | ◎ | ◎ | ◎ |
| | Void resistance | | X | X | X | X | ○ | ○ | ○ | ○ | X | X | X |
| | Odor upon flash fixing | | ○ | ○ | ○ | ○ | ○ | ○ | ○ | ○ | ○ | ○ | ○ |
| | Resolution | | ○ | ○ | ○ | ○ | ○ | ○ | ○ | ○ | ○ | ○ | ○ |
| | Remaining amount of components with a weight-average molecular weight of 500 or less (mass %) | | 2.1 | 2.1 | 2.1 | 2.1 | 2.1 | 2.1 | 2.1 | 2.1 | 2.1 | 2.1 | 2.1 |

TABLE 3

| Item | Name | | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ex. 16 |
|---|---|---|---|---|---|---|---|---|---|---|---|---|---|---|
| Material | Yellow pigment | Brilliant yellow 2GX70 | — | — | — | — | — | — | — | — | — | — | — | 8 |
| | Magenta pigment | Red Violet ER02 | — | — | — | — | — | — | — | — | — | — | 5 | — |
| | Cyan pigment | Blue B2G | 4 | 4 | 4 | 4 | 4 | 4 | 4 | 4 | 4 | 4 | — | — |
| | Binder resin | Polyester A (no soft segment) | 92.5 | 92.5 | 92.5 | — | — | 93.4 | 93.2 | 88.5 | 93.3 | 91.5 | 91.5 | 88.5 |
| | | Polyester B (soft segment 2 mol %) | — | — | — | 92.5 | — | — | — | — | — | — | — | — |
| | | Polyester B (soft segment 12 mol %) | — | — | — | — | 92.5 | — | — | — | — | — | — | — |
| | Charge control agent | E-89 (calixarene, Orient) | 1 | 1 | 1 | 1 | 1 | 1 | 1 | 1 | 1 | 1 | 1 | 1 |
| | Infrared absorbent | SIR-130 | 0.5 | 0.5 | 0.5 | 0.5 | 0.5 | 0.5 | 0.5 | 0.5 | 0.5 | 0.5 | 0.5 | 0.5 |
| | Wax | Wax A-1 | | — | — | — | — | — | — | — | — | — | — | — |
| | | Wax A-2 | | — | — | — | — | — | — | — | — | — | — | — |
| | | Wax A-3 | | — | — | — | — | — | — | — | — | — | — | — |
| | | Wax A-4 | 1 | 1 | 1 | 1 | 1 | 0.1 | 0.3 | 5 | 1 | 1 | 1 | 1 |
| | | Wax A-5 | — | — | — | — | — | — | — | — | — | — | — | — |
| | | Wax A-6 | — | — | — | — | — | — | — | — | — | — | — | — |

TABLE 3-continued

| Item | Name | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ex. 16 |
|---|---|---|---|---|---|---|---|---|---|---|---|---|---|
| | Wax B-1 | — | — | — | — | — | — | — | — | — | — | — | — |
| | Wax B-2 | — | — | — | — | — | — | — | — | — | — | — | — |
| | Wax B-3 | — | — | — | — | — | — | — | — | — | — | — | — |
| | Wax B-4 | — | — | — | — | — | — | — | — | — | — | — | — |
| | Wax B-5 | — | — | 0.5 | — | 0.5 | 0.5 | 0.5 | 0.5 | 0.1 | 2 | 0.5 | 0.5 |
| | Wax B-6 | — | — | — | — | — | — | — | — | — | — | — | — |
| | Wax B-7 | — | — | — | — | — | — | — | — | — | — | — | — |
| | Wax B-8 | — | — | — | — | — | — | — | — | — | — | — | — |
| | Wax B-9 | — | — | — | — | — | — | — | — | — | — | — | — |
| | Wax B-10 | — | — | — | — | — | — | — | — | — | — | — | — |
| | Wax B-11 | — | — | — | — | — | — | — | — | — | — | — | — |
| | Wax C-1 | 1 | — | 0.5 | 0.5 | 0.5 | 0.5 | 0.5 | 0.5 | 0.1 | 2 | 0.5 | 0.5 |
| | Wax C-2 | — | 1 | — | — | — | — | — | — | — | — | — | — |
| | Wax C-3 | — | — | — | — | — | — | — | — | — | — | — | — |
| | Wax C-4 | — | — | — | — | — | — | — | — | — | — | — | — |
| Fixability | | ◎ | ◎ | ◎ | ◎ | ◎ | Δ | ○ | ◎ | ◎ | ◎ | ◎ | ◎ |
| Void resistance | | ○ | ○ | ◎ | ◎ | ◎ | ○ | ◎ | ◎ | Δ | ◎ | ◎ | ◎ |
| Odor upon flash fixing | | ○ | ○ | ○ | ○ | Δ | ○ | ○ | ○ | ○ | ○ | ○ | ○ |
| Resolution | | ○ | ○ | ◎ | ◎ | ◎ | ○ | ◎ | Δ | ○ | Δ | ◎ | ◎ |
| Remaining amount of components with a weight-average molecular weight of 500 or less (mass %) | | 2.1 | 2.1 | 2.1 | 3.8 | 7.9 | 2.2 | 2.2 | 2.2 | 2.2 | 2.2 | 2.2 | 2.2 |

TABLE 4

| Item | | Name | Comp. Ex. 8 | Comp. Ex. 9 | Comp. Ex. 10 | Comp. Ex. 11 | Comp. Ex. 12 | Comp. Ex. 13 | Comp. Ex. 14 |
|---|---|---|---|---|---|---|---|---|---|
| Material | Cyan pigment | Blue B2G | 4 | 4 | 4 | 4 | 4 | 4 | 4 |
| | Binder resin | Polyester A (no soft segment) | 94.5 | 93.5 | 93.5 | 93.5 | 93.5 | 93.5 | 93.5 |
| | | Polyester B (soft segment 2 mol %) | — | — | — | — | — | — | — |
| | | Polyester B (soft segment 12 mol %) | — | — | — | — | — | — | — |
| | Charge control agent | E-89 (calixarene, Orient) | 1 | 1 | 1 | 1 | 1 | 1 | 1 |
| | Infrared absorbent | SIR-130 | 0.5 | 0.5 | 0.5 | 0.5 | 0.5 | 0.5 | 0.5 |
| | Wax | Wax A-1 | — | 1 | — | — | — | — | — |
| | | Wax A-2 | — | — | 1 | — | — | — | — |
| | | Wax A-3 | — | — | — | 1 | — | — | — |
| | | Wax A-4 | — | — | — | — | 1 | — | — |
| | | Wax A-5 | — | — | — | — | — | 1 | — |
| | | Wax A-6 | — | — | — | — | — | — | 1 |
| | | Wax B-1 | — | — | — | — | — | — | — |
| | | Wax B-2 | — | — | — | — | — | — | — |
| | | Wax B-3 | — | — | — | — | — | — | — |
| | | Wax B-4 | — | — | — | — | — | — | — |
| | | Wax B-5 | — | — | — | — | — | — | — |
| | | Wax B-6 | — | — | — | — | — | — | — |
| | | Wax B-7 | — | — | — | — | — | — | — |
| | | Wax B-8 | — | — | — | — | — | — | — |
| | | Wax B-9 | — | — | — | — | — | — | — |
| | | Wax B-10 | — | — | — | — | — | — | — |
| | | Wax B-11 | — | — | — | — | — | — | — |
| | | Wax C-1 | — | — | — | — | — | — | — |
| | | Wax C-2 | — | — | — | — | — | — | — |
| | | Wax C-3 | — | — | — | — | — | — | — |
| | | Wax C-4 | — | — | — | — | — | — | — |
| Fixability | | | X | ○ | ○ | ○ | ◎ | X | ○ |
| Void resistance | | | X | X | X | X | X | X | X |
| Odor upon flash fixing | | | ○ | X | X | ○ | ○ | ○ | X |
| Resolution | | | ○ | ○ | ○ | ○ | ○ | ○ | ○ |
| Remaining amount of components with a weight-average molecular weight of 500 or less (mass %) | | | 2.1 | 2.8 | 2.5 | 2.1 | 2.2 | 2.2 | 2.6 |

Incidentally, the details of the waxes and the pigments used in Tables 2 to 4 are shown in Tables 5 and 6, respectively. Further, as the infrared absorbent, a nickel complex (tradename; SIR-130, manufactured by Mitsui Chemicals, Inc., maximum absorption wavelength (nm); 855 nm, color tone; brown) was used.

TABLE 5

| Name | Name of material | Product name | Manufacturer | Melting point (° C.) | Molecular weight Mw | Mn | Mw/Mn | Amount of components with a molecular weight of 500 or less (wt %) |
|---|---|---|---|---|---|---|---|---|
| Wax A-1 | Paraffin wax | 135° | Nippon Oil Corp. | 65 | 325 | 250 | 1.3 | 75 |
| Wax A-2 | Ester wax | WEC-3 | NOF Corp. | 73 | 680 | 620 | 1.1 | 42 |
| Wax A-3 | Ester wax | WEC-4 | NOF Corp. | 71 | 1192 | 1060 | 1.1 | 1 % or less |
| Wax A-4 | Ester wax | WEP-5F | NOF Corp. | 83 | 1530 | 1320 | 1.2 | 1 % or less |
| Wax A-5 | Ester wax | J797 | Cyukyo Yushi Co., Ltd. | 99 | 1569 | 1220 | 1.3 | 1 % or less |
| Wax A-6 | Carnauba wax | No. 1 | S. KATO & Co. | 75 | 1200 | 600 | 2.0 | 18 |
| Wax B-1 | Polyethylene | 200P | Mitsui Chemicals, Inc. | 121 | 2814 | 999 | 2.8 | 1 % or less |
| Wax B-2 | Polyethylene | NL900 | Mitsui Chemicals, Inc. | 123 | 15000 | 4200 | 3.6 | 1 % or less |
| Wax B-3 | Polyethylene | C-10 | Eastman Chemical Company | 108 | 35000 | 7700 | 4.5 | 1 % or less |
| Wax B-4 | Polyethylene | 200P/800P = 1/1 | Mitsui Chemicals, Inc. | 122 | 6800 | 1450 | 4.7 | 1 % or less |
| Wax B-5 | Polyethylene | C-13 | Eastman Chemical Company | 110 | 76000 | 12000 | 6.3 | 1 % or less |
| Wax B-6 | Polyethylene | C-17 | Eastman Chemical Company | 115 | 100000 | 14000 | 7.1 | 1 % or less |
| Wax B-7 | Polyethylene | 200P/NL900 = 1/1 | Mitsui Chemicals, Inc. | 122 | 8940 | 1670 | 5.4 | 1 % or less |
| Wax B-8 | Polyethylene | 200P/C-10 = 1/1 | Mitsui Chemicals, Inc./Eastman Chemical Company | 120 | 25000 | 4350 | 5.7 | 1 % or less |
| Wax B-9 | Ethylene/propylene copolymer | NP105 | Mitsui Chemicals, Inc. | 144 | 14400 | 4400 | 3.3 | 1 % or less |
| Wax B-10 | Ethylene/propylene copolymer | 55OP | Sanyo Chemicals Industries Ltd. | 140 | 8000 | 2000 | 4.0 | 1 % or less |
| Wax B-11 | Ethylene/propylene copolymer | 33OP | Sanyo Chemicals Industries Ltd. | 148 | 32000 | 8000 | 4.0 | 1 % or less |
| Wax C-1 | Polypropylene | NP500 | Mitsui Chemicals, Inc. | 159 | 40000 | 12000 | 3.3 | 1 % or less |
| Wax C-2 | Polypropylene | NP800 | Mitsui Chemicals, Inc. | 170 | 80000 | 20000 | 4.0 | 1 % or less |

In Table 5, the chemical structure of "WEC-4" is: $C[CH_2—O—CO—(CH_2)_{14}—CH_3]_4$. The chemical structure of "WEP-5F" is: $C[CH_2—O—CO—(CH_2)_{20}—CH_3]_4$. The "200P/800P=1/1" in wax B-4 is a 1-to-1 blend product of 200P and 800P (manufactured by Mitsui Chemicals, Inc.). The "200P/NL900P=1/1" in wax B-7 is a 1-to-1 blend product of 200P and NL900P. The "200P/C-10=1/1" is a 1-to-1 blend product of 200P and C-10.

TABLE 6

| | C.I. pigment | Primary particle diameter (nm) | Product No | Manufacturer |
|---|---|---|---|---|
| Yellow pigment | Yellow 74 | 230 | Brilliant yellow 2GX70 | Clariant |
| Magenta pigment | Violet 19 | 60 | Red Violet ER02 | Clariant |
| Cyan pigment | Blue 15:3 | 60 | Blue B2G | Clariant |

The results of Table 4 indicate as follows. As evaluated in Comparative Examples 2 to 7, an improvement has been achieved in terms of the fixability by a wax having a melting point of 90° C. or less (i.e., a wax having a peak at 0 to 90° C. wherein the peak is the endothermic peak in the temperature-rising stage of the DSC curve) (Comparative Examples 2 to 5, and Comparative Example 7). However, when a wax having a high content of the components each with a weight-average molecular weight (Mw) of 500 or less was used (Comparative Examples 2 and 3), and when a wax having a molecular weight distribution (weight-average molecular weight (Mw)/number-average molecular weight (Mn)) of more than 1.5 was used (Comparative Example 7), contamination of paper due to sublimation, apparatus contamination, occurrence of odor, and the like were observed upon flash fixing. Further, voids were observed for any toner for electrophotography.

The results of Table 2 indicate as follows. When a wax having a melting point of 90° C. or less, a low content of the components each with a weight-average molecular weight (Mw) of 500 or less, and a molecular weight distribution (weight-average molecular weight (Mw)/number-average molecular weight (Mn)) of 1.5 or less was used in combination with a wax having a melting point of 100 to 150° C. (Examples 1 to 4, Comparative Examples 8 to 11, and Comparative Examples 12 to 14), and when a wax having a molecular weight distribution (Mw/Mn) of 5 to 20 was used as a wax having a melting point of 100 to 150° C. (Examples 1 to 4), both of the fixability and the void resistance were excellent.

The results of Table 3 indicate as follows. When a wax having a melting point of 90° C. or less, a low content of the components each with a weight-average molecular weight (Mw) of 500 or less, and a molecular weight distribution (weight-average molecular weight (Mw)/number-average molecular weight (Mn)) of 1.5 or less was used in combination with a wax having a melting point of 150° C. or more for evaluation, the void resistance was excellent irrespective of the molecular weight distribution (Mw/Mn) in the wax having a melting point of 150° C. or more (Examples 5 and 6).

When a wax having a melting point of 90° C. or less, a low content of the components with a weight-average molecular weight (Mw) of 500 or less, and a molecular weight distribution (weight-average molecular weight (Mw)/number-average molecular weight (Mn)) of 1.5 or less, a wax having a melting point of 150 to 170° C. and a molecular weight distribution (Mw/Mn) of 5 to 20, and a wax having a melting point of 150 to 170° C. were used in combination for evaluation, the same excellent image quality as with a heating roll was obtained (Example 7).

When a soft segment-containing product was used as the binder resin, the fixability and the void resistance were excellent, but some odor occurred due to the residual monomers (Examples 8 and 9).

As for the content of the wax having a melting point of 90° C. or less, a low content of the components with a weight-average molecular weight (Mw) of 500 or less, and a molecular weight distribution (weight-average molecular weight (Mw)/number-average molecular weight (Mn) of 1.5 or less, a content of 0.1 mass % resulted in slightly poor fixability (Example 10). Whereas, a content of 5 mass % resulted in inferior toner fluidity, image disturbance, and a reduction in resolution (Example 12).

As for the content of the wax having a melting point of 100 to 150° C., and a molecular weight distribution (Mw/Mn) of 5 to 20, a content of 0.1 mass % resulted in slightly poor void resistance (Example 13). Whereas, a content of 2 mass % resulted in inferior toner fluidity, image disturbance, and a reduction in resolution (Example 14). Further, the yield upon manufacturing of the toner also decreased by about 10%.

Also in Examples 15 and 16 using different pigments from those for Examples 1 to 14, favorably, the fixability and the void resistance were excellent.

In accordance with the present invention, it is possible to provide a toner for electrophotography, a developer for electrophotography, a process cartridge, an apparatus for forming an image, and a method for forming an image, which are capable of solving the various problems in related art, achieves a high-level compatibility between the fixability and the void resistance, and is capable of forming a high-quality image.

What is claimed is:

1. A toner for electrophotography, comprising a cyan toner, a magenta toner and a yellow toner, wherein each of the cyan toner, magenta toner and yellow toner comprises:

an infrared absorbent;

a binder resin; and a wax component, wherein the wax component contains a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and containing a component having a weight-average molecular weight (Mw) of 500 or less in an amount of 1% by mass of the wax component or less; and a second wax having an endothermic peak in a temperature region of 150 to 170° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.1 or more.

2. A toner for electrophotography according to claim 1, further comprising a third wax having an endothermic peak in a temperature region of 100 to 150° C., the endothermic peak occurring in the temperature-rising stage of a DSC curve determined by a differential scanning calorimeter, and having a molecular weight distribution (weight-average molecular weight (Mw)/number-average molecular weight (Mn)) of more than 5 to 20.

3. A toner for electrophotography according to claim 2, wherein the first wax is selected from an ester wax represented by the following general formula; the third wax is selected from a polyethylene wax; and the second wax is selected from the group consisting of a polypropylene wax and a wax of a copolymeric product of polyethylene and polypropylene:

$C—[CH_2—O—CO—(CH_2)_n—CH_3]_4$ where n expresses an integer of 3 or more.

4. A toner for electrophotography according to claim 3, wherein the content of the ester wax is 0.1 to 5% by mass based on the mass of each of the cyan, magenta, and yellow toners and the content of each of the remainder of the waxes is 0.1 to 1% by mass based on the mass of each of the cyan, magenta, and yellow toners.

5. A toner for electrophotography according to claim 1, wherein the content of a component having a weight-average molecular weight (Mw) of 500 or less in the fiest wax is 0.8% by mass or less.

6. A toner for electrophotography according to claim 1, wherein the molecular weight distribution (weight-average molecular weight (Mw)/number-average molecular weight (Mn) in the second wax is 2.0 or more.

7. A toner for electrophotography according to claim 1, wherein the content of a component having a weight-average molecular weight (Mw) of 500 or less is 0.6 mass% or less.

8. A toner for electrophotography according to claim 1, wherein the binder resin is selected from a polyester resin.

9. A toner for electrophotography according to claim 8, wherein the polyester resin is obtained by using a bisphenol A alkylene oxide adduct in an amount of 80 mol% or more based on the amount of a raw material alcohol component.

10. A toner for electrophotography according to claim 9, wherein the bisphenol A alkylene oxide adduct is represented by the following structural formula:

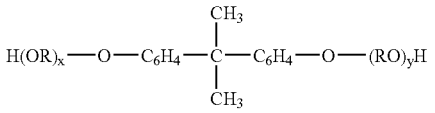

where R expresses an ethylene group or a propylene group; and x and y each expresses an integer of 1 or more.

11. A toner for electrophotography according to claim 8, wherein the polyester resin is obtained by using a bisphenol A alkylene oxide adduct in an amount of 95 mol% or more based on the amount of a raw material alcohol component.

12. A toner for electrophotography according to claim 8, wherein the content of a soft segment in the total monomers is less than 2 mol% in the polyester resin.

13. A toner for electrophotography according to claim 1, wherein the content of the infrared absorbent is 0.1 to 1.5% by mass of each of the cyan, magenta, and yellow toners.

14. A developer for electrophotography, comprising a carrier and a toner for electrophotography which comprises a cyan toner, a magenta toner and a yellow toner, wherein each of the cyan toner, magenta toner and yellow toner comprises:

an infrared absorbent;

a binder resin; and a wax component, wherein the wax component contains a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and containing a component having a weight-average molecular weight (Mw) of 500 or less in an amount of 1% by mass of the wax component or less; and a second wax having an endothermic peak in a temperature region of 150 to 170° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.1 or more.

15. A process cartridge, comprising:

an electrostatic latent image carrier; and means for developing an electrostatic latent image carried on the electrostatic latent image carrier using a toner for electrophotography, and forming a visible image, comprising a developer container containing the toner for electrophotography wherein the toner for electrophotography comprises a cyan toner, a magenta toner and a yellow toner, wherein each of the cyan toner, magenta toner and yellow toner comprises:

an infrared absorbent a binder resin; and a wax component, wherein the wax component contains a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and containing a component having a weight-average molecular weight (Mw) of 500 or less in an amount of 1% by mass of the wax component or less; and a second wax having an endothermic peak in a temperature region of 150 to 170° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.1 or more.

16. An apparatus for forming an image comprising:

an electrostatic latent image carrier;

means for forming an electrostatic latent image on the electrostatic latent image carrier;

means for developing the electrostatic latent image using a toner for electrophotography, and forming a visible image, comprising a development unit containing the toner for electrophotography;

means for transferring the visible image on a recording medium; and means for flash fixing a transfer image formed by the visible image transferred on the recording medium, wherein the toner for electrophotography comprises a cyan toner, a magenta toner and a yellow toner, wherein each of the cyan toner, magenta toner and yellow toner comprises:

an infrared absorbent;

a binder resin; and a wax component, wherein the wax component contains a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and containing a component having a weight-average molecular weight (Mw) of 500 or less in an amount of 1% by mass of the wax component or less; and a second wax having an endothermic peak in a temperature region of 150 to 170° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.1 or more.

17. An apparatus for forming an image according to claim 16, said means for flash fixing the transfer image is adapted to output light energy of 2 to 7 J/cm$^2$.

18. A method for forming an image, comprising:

a step for forming an electrostatic latent image on an electrostatic latent image carrier;

a step for developing the electrostatic latent image using a toner for electrophotography, and forming a visible image;

a step for transferring the visible image on a recording medium; and a step for flash fixing a transfer image formed by the visible image transferred on the recording medium;

wherein the toner for electrophotography comprises a cyan toner, a magenta toner, and a yellow toner, wherein each of the cyan toner, magenta toner and yellow toner comprises:

an infrared absorbent;

a binder resin; and a wax component, wherein the wax component contains a first wax having an endothermic peak in a temperature region of 60 to 90° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.5 or less, and containing a component having a weight-average molecular weight (Mw) of 500 or less in an amount of 1% by mass of the wax component or less; and a second wax having an endothermic peak in a temperature region of 150 to 170° C., the endothermic peak occurring in the temperature-rising stage of a DSC curve determined by a differential scanning calorimeter, and having a molecular weight distribution (weight-average molecular weight (Mw)/number-average molecular weight (Mn)) of 1.1 or more.

* * * * *